United States Patent [19]

Lehmacher

[11] 4,398,903

[45] Aug. 16, 1983

[54] METHOD OF AND APPARATUS FOR MAKING HANDLE BAGS

[76] Inventor: Hans Lehmacher, Im Hummerich, 5126 Niederkassel-Mondorf, Fed. Rep. of Germany

[21] Appl. No.: 231,878

[22] Filed: Feb. 5, 1981

[30] Foreign Application Priority Data

Feb. 6, 1980 [DE] Fed. Rep. of Germany ..... 3004220

[51] Int. Cl.[3] ..... B31B 1/18; B31B 1/86

[52] U.S. Cl. ..... 493/197; 83/428; 493/226; 493/227; 493/369; 493/926

[58] Field of Search ..... 83/428; 493/197, 196, 493/195, 194, 193, 926, 226, 236, 235, 227, 369

[56] References Cited

U.S. PATENT DOCUMENTS

| | | | |
|---|---|---|---|
| 449,057 | 3/1891 | Perkins | 83/428 |
| 1,127,448 | 2/1915 | Jullien | 83/428 X |
| 2,214,593 | 9/1940 | Mustin et al. | 493/29 |
| 4,164,170 | 8/1979 | Nordin | 493/194 |
| 4,174,657 | 11/1979 | Suominen | 493/197 |
| 4,273,014 | 6/1981 | Edling | 83/428 X |

FOREIGN PATENT DOCUMENTS

| | | | |
|---|---|---|---|
| 2608734 | 9/1977 | Fed. Rep. of Germany | 493/193 |

*Primary Examiner*—James F. Coan

*Attorney, Agent, or Firm*—Karl F. Ross; Herbert Dubno

[57] ABSTRACT

A handle bag of a predetermined width is made from a synthetic-resin tube. This tube is fed at a predetermined feed speed through a cutting station where it is spanned over a cutting drum formed with an endless circumferentially extending and undulating cutting groove. A blade engages radially inwardly through this groove so that as the tube passes over the drum it is subdivided transversely into a pair of tube halves. The blade reciprocates back and forth transversely of the tube in the cutter groove by rotation of the drum at such a rate as to form on the confronting cut edges of the tube halves interfitting and staggered handle flaps. One of these tube halves is then detoured through a distance equal to an odd whole-number multiple of half of the bag width and then is realigned with the other tube half with the flaps in transverse alignment. The two tube halves are then seamed together simultaneously.

9 Claims, 5 Drawing Figures

METHOD OF AND APPARATUS FOR MAKING HANDLE BAGS

FIELD OF THE INVENTION

The present invention relates to a method of and apparatus for making handle bags. More particularly this invention concerns the mass-production manufacture of shopping bags from a thermoplastic synthetic-resin tube.

BACKGROUND OF THE INVENTION

It is known to make handle bags of a predetermined bag width from an elongated synthetic-resin tube by advancing the tube in steps of the length equal to the bag width between a matching die and anvil. Between each advanced step the die and anvil are brought together to make a longitudinally extending and transversely undulating cut through the tube having a longitudinal length equal approximately to the bag width. This die therefore subdivides the tube downstream of itself transversely into a pair of tube halves having staggered and interfitting handle flaps.

One of the tube halves is then detoured through a distance equal to an odd-whole-number multiple of half of the bag width and then is brought back into transverse alignment with the other tube half, but obviously with the handle flaps now in perfect transverse alignment. Transverse weld seams, normally constituted as a pair of transverse welds separated by a perforation line, are formed on both of the tube halves simultaneously equidistant between the flaps.

Such an arrangement, which is generally described in German Pat. No. 1,244,547, therefore produces a succession of handle bags with minimum waste. The only part of the tube that might be wasted would be the part that is punched out of each flap to form a hand hole, and in many cases this hand hole is only punched out on three sides so that there is no waste whatsoever.

A disadvantage of this system is that it operates relatively slowly due to the step-wise advance of the tube. An even greater disadvantage is that the system cannot be adapted to make bags of different widths without changing the die and anvil. Obviously the die and anvil are relatively expensive items which not only cost quite a bit themselves, but which take some time to change.

OBJECTS OF THE INVENTION

It is therefore an object of the present invention to provide an improved method of an apparatus for making handle bags of a flattened synthetic-resin tube.

Another object is to provide a system which can operate continuously, not step wise.

Yet another object is to provide such a method and apparatus which allows bags of different bag widths to be produced with only minor adjustment of the machine.

SUMMARY OF THE INVENTION

These objects are attained according to the instant invention in a system wherein the tube is fed through a cutting station at a predetermined feed speed. A cutter is engaged through the tube at the station so as to subdivide it transversely into a pair of tube halves. This cutter is reciprocated back and forth transversely of the tube in the station at such a rate as to form on the confronting cut edges of the halves interfitting and staggered handle flaps. One of the tube halves may then be detoured through a distance equal to an odd whole-number multiple of half of the bag width and then is realigned with the other tube half with the flaps in transverse alignment. The tube halves are then simultaneously seamed together.

More particularly according to this invention the cutter is a blade and the cutting station has a cutting drum formed with an endless circumferentially extending and undulating cutting groove in which the blade engages radially. Another undulating guide groove parallel to the cutting groove but axially offset therefrom is engaged by a cam follower connected to the blade so that the blade exactly tracks the cutting groove. The drum is rotated at a peripheral speed whih normally varies from the feed speed, so that the tube slips on the drum. If the peripheral speed of the drum is identical to the feed speed the bag width will be exactly equal to the circumference of the drum. If the peripheral speed is greater the bag width will be shorter than the circumference of the drum and if the peripheral speed is slower the bag width will be greater than the circumference of the drum. Thus merely by changing the rotation rate for the drum it is possible to vary the bag width.

The rotation rate which determines the peripheral speed of the cutting drum normally forms a direct relationship with the rotation rate for upstream and downstream feed rollers that supply the tube to the drum at the feed speed and pull it off the drum also at the feed speed. For absolute synchronization a sprocket is provided on the cutting drum and on one of the feed rollers, with a chain interconnecting these sprockets. One or both of the sprockets may be changed to vary the transmission ratio between them and thereby change the bag width.

According to another feature of this invention the means for detouring the one tube half through a distance equal to an odd whole-number multiple of the bag width constitutes a group of deflecting guide rollers one of which may be displaced relative to the other to vary the extent of the detour. Obviously when the bag width is changed the length of the detour must similarly be changed.

In accordance with further features of this invention the blade is flat and means is provided for rotating it about an axis generally perpendicular to the axis of the drum so that the blade is always parallel to that section of the cutting groove in which it is engaged at any given instant. Since the blade does not touch the walls of the cutting groove as it is guided by a separate heavy-duty cam-follower structure and a larger groove axially offset from the cutting groove, blade wear will therefore be reduced to an absolute minimum. The cam follower engaging in the guide groove is carried on one or two rods that are fixed and extend parallel to the rotation axis of the drum, and the support for the blade is similarly carried on a pair of such rods, which may even be the same rods. An axially extending rigid element interconnects the cam follower and the blade support.

SPECIFIC DESCRIPTION

Figure 1:
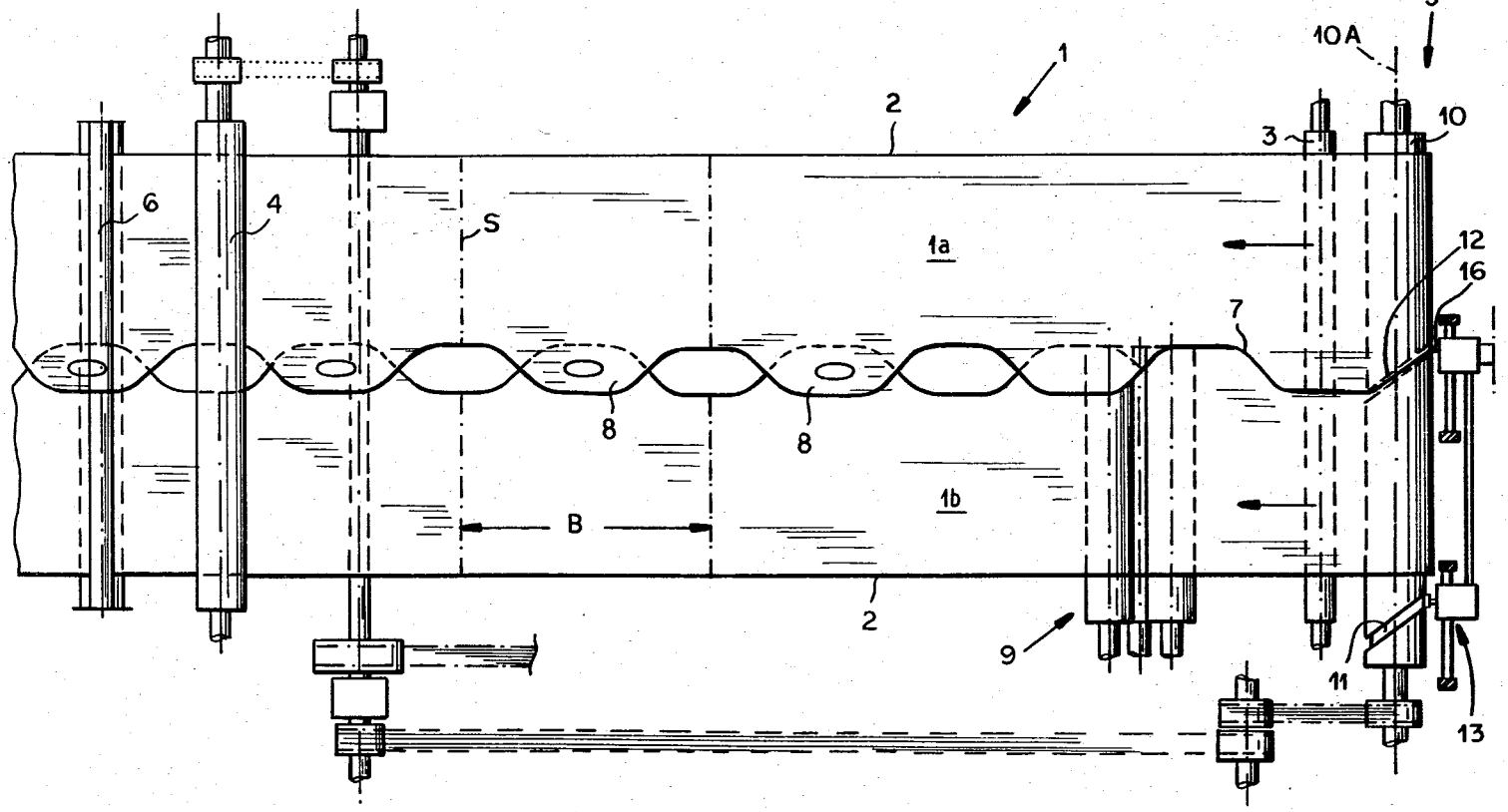
FIG. 1 is a partly schematic top view showing the apparatus for carrying out the method according to this invention.
Figure 2:
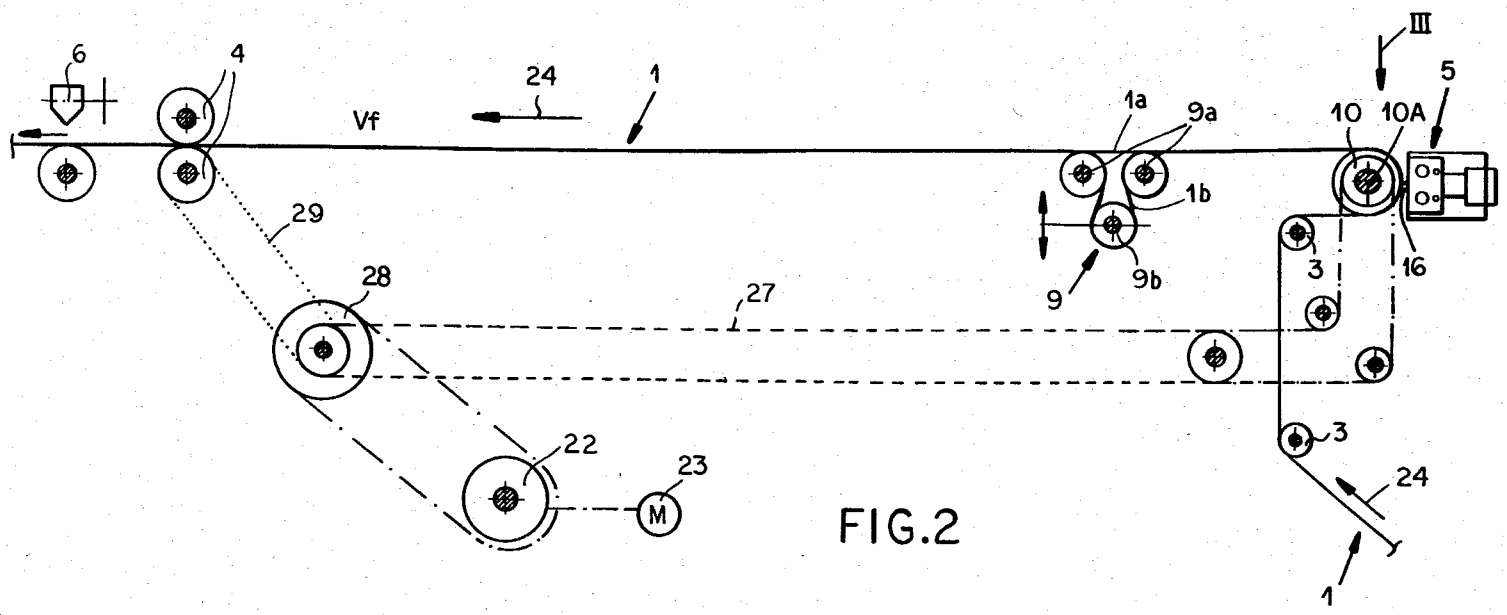
FIG. 2 is a side view of the apparatus of FIG. 1.

As seen in FIGS. 1 and 2 a polyethylene tube 1 that is flattened out and may have its edges tucked in to form bags with flat bottoms has a pair of longitudinal edges 2. This tube 1 is fed over upstream drive rollers 3 and between downstream drive rollers 4 all operated by chain drive from a sprocket 22 driven by means of an electric motor 23. Thus the flat tube or web workpiece is advanced in the direction 24 at a feed speed Vf. Immediately downstream of the upstream advance rollers 3 the tube 1 passes through a cutting station 5 and immediately downstream of the downstream rollers 4 passes underneath a welding bar 6. At the cutting station 5 an undulating cut 7 is formed in the tube 1 subdividing it into adjacent tube halves 1*a* and 1*b* each having one of the edges 2 and each having at its cut edge confronting the other half a succession of handle flaps 8.

The tube half 1*b* is detoured through a distance equal to an odd whole-number multiple of the bag width B at a deflecting arrangement 9 comprising a pair of rollers 9*a* flanking an off-center roller 9*b* which may be moved toward and away from the plane defined by the axes the parallel rollers 9*a* so as to increase or decrease the length of the detour. Thus downstream in the direction 24 from the detouring arrangement 9 the handles 8 is visible in FIG. 1 will be in a transverse overlapping alignement with each other.

Figure 3:
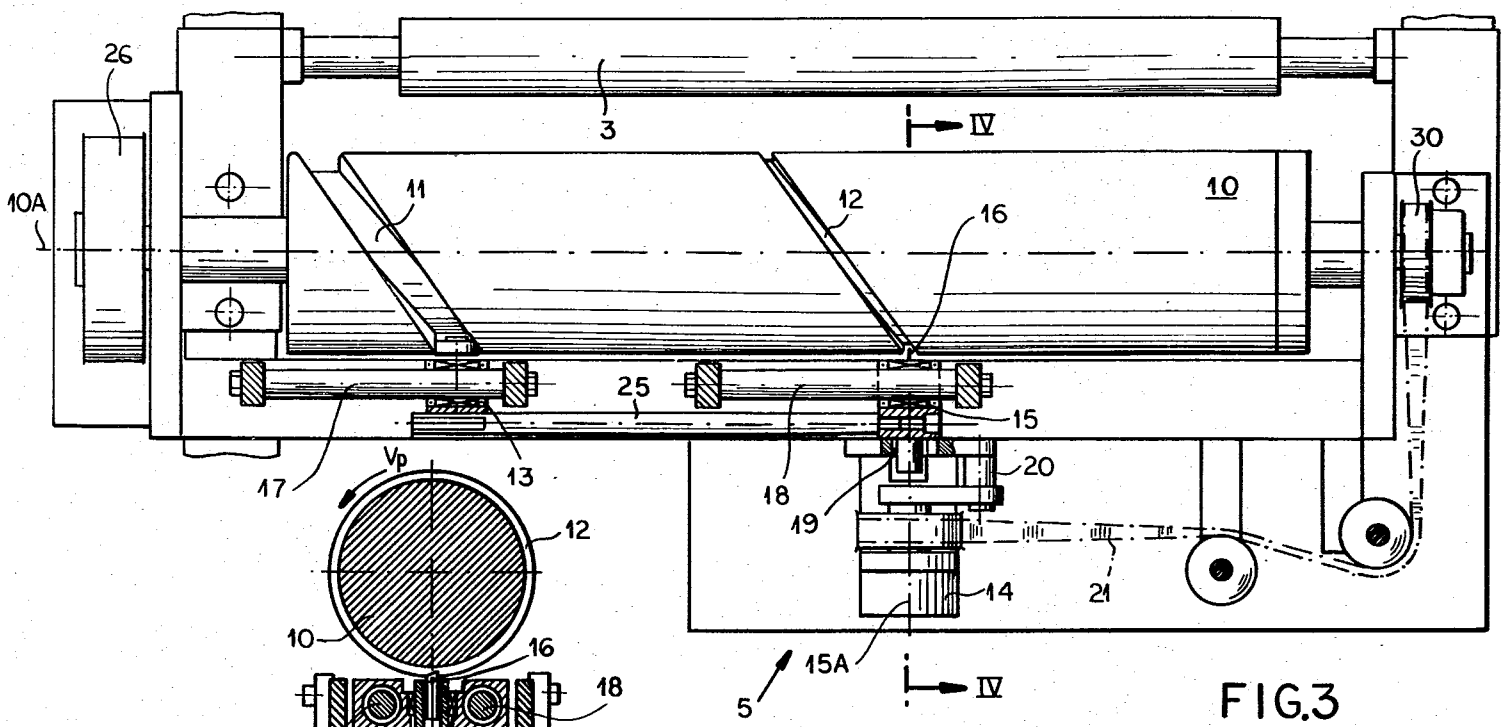
FIG. 3 is a large-scale and partly sectional view taken in the direction of arrow III of FIG. 2.
Figure 4:
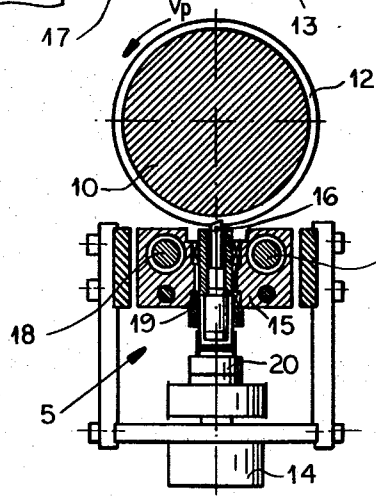
FIG. 4 is a cross section taken along line IV—IV of FIG. 3.

At the cutting station 5 the flattened tube 1 is spanned through 180° over a drum 10 rotatable about a horizontal axis 10A and formed as best shown in FIG. 3 adjacent one end with a relatively wide undulating guide groove 11 and at approximately its center with a narrower cutting groove 12. The grooves 11 and 12 are generally elliptical and are circumferentially endless. A cam follower 13 has a roller engaging in the guide groove 11 and is carried on a pair of guide rods 17 so that it can move easily parallel to the axis 10A. A blade 16 engages radially inwardly in the groove 12 as best shown in FIG. 4 and is carried in a seat 19 in a holder 15 that is axially displaceable on guide rods 18 parallel to the axis 10A. A rigid rod 25 axially interconnects the cam follower 13 with the holder 15 so that the blade 16 will always ride exactly in the center of the groove 12 without touching either of its sides.

The drum 10 has at one end a pulley or sprocket 26 driven via a timing belt or chain 27 from the main drive pulley 28 to which is connected the timing belt or chain 29 that drives the downstream feed rollers 4 and is similarly connected to the upstream feed rollers 3. Thus this drum 10 will operate perfectly synchronously with the feed rollers 3 and 4.

As the flattened tube 1 passes over the drum 10, therefore, the sinusoidal cut 7 will be formed. The repeat of this cut 7 establishes the bag width B and is in turn established by the relationship between the peripheral speed Vp of the drum 10 and the feed speed Vf. If Vp and Vf are identical the distance B will be equal to the circumference of the drum 10. If the peripheral speed Vp is greater than the feed speed Vf the distance b will be smaller than the circumference of the drum 10 and vice versa. Of course if the grooves 11 and 12 were not elliptical but undulated back and forth several times on the circumference of the drum 10 the relationship would correspondingly change.

It is therefore possible to vary the bag width B with the system according to this invention simply by varying the speeds Vf and Vp relative to each other. This can most easily be done by changing the sprocket or pulley 26. Once the appropriate ratio between the two speeds has been obtained the system can be operated at virtually any speed and perfectly synchronous operation will be insured. Of course as the bag width B is changed the roller 9*b* must be moved appropriately to insure perfect alignment of the handles 8 downstream of the detour arrangement 9. This adjustment can easily be carried out empirically once the machine is running.

In order to insure that a perfect cut is made and to minimize wear on the blade 16 the holder 15 is rotatable about an axis 15A on a support 14 and can be pivoted by means of a cam arrangement 20 operated by a belt 21 driven off a pulley 30 at the opposite end of the drum 10 so that the blade 16 which is a planar is always perfectly parallel to the portion of the groove 12 in which it lies. Such alignment of the blade 16 insures that the blade will have a very long service life and the tube 1 will lie flat as it is being cut and after it is cut.

Figure 5:
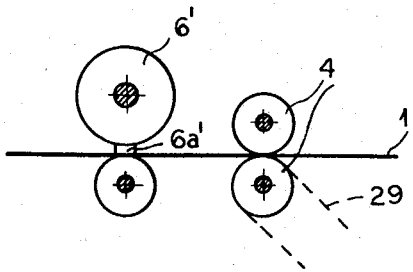
FIG. 5 is a view corresponding to a detail of FIG. 2 but showing an alternative portion of the apparatus according to this invention.

After passing through the downstream feed rollers 6 the two tube halves 1*a* and 1*b* are seamed together at seams indicated in dot-dash lines at s in FIG. 1 that are perfectly equidistant between the flaps 8. The use of a vertically reciprocal welding bar 6 which forms a pair of welds flanking a row of perforations requires intermittent step-wise advance of the tube 1. This step-wise advance can be avoided by making the welding bar 6 and its anvil axially reciprocal in the direction 24. It is also possible as shown in FIG. 5 to use a welding drum 6' having a welding edge 6*a'* which rotates at a peripheral speed identical to the speed Vf for continuous operation.

Thus with the system according to the instant invention it is possible to produce handle bags of virtually any bag width with the same machine. Simply changing a sprocket or adjusting a variable-ratio transmission allows the bag width to be varied. The machine can also operate at extremely high speed as the cutting is done continuously and not step wise.

I claim:

1. A method of making handle bags of a predetermine bag width from an elongated synthetic-resin tube, said method comprising the steps of:

feeding said tube through a cutting station at a predetermined feed speed;

engaging a cutter through said tube at said station to subdivide said tube transversely into a pair of tube halves;

reciprocating said cutter back and forth transversely of said tube in said station at such a rate as to form on the confronting cut edges of said halves interfitting and staggered handle flaps; and transversely seaming together each of said tubes at seams between said flaps, said tube being flattened and passed over a cutting drum at said station, said drum being formed with a circumferentially endless and undulating cutting groove, said cutter being a blade guided by said groove.

2. The method defined in claim 1, further comprising the steps before seaming together of said halves and after subdividing said tube transversely of sequentially;

detouring one of said tubes halves through a distance equal to an odd whole-number multiple of half of said bag width; and realigning said one tube half with said other tube half with said flaps in transverse alignment, said tube halves being seamed together simultaneously.

3. An apparatus for making handle bags of a predetermined bag width from an elongated synthetic-resin tube, said apparatus comprising:

a cutting drum formed with an endless circumferentially extending undulating cutting groove, centered on and rotatable about a drum axis, and having a circumference different from said bag width;

feed means including a downstream feed roller and an upstream feed roller both engaging said tube for advancing same from said upstream roller to said downstream roller over said drum at a predetermined feed speed;

a blade engaging radially inwardly in said groove, whereby said tube on passing over said drum is subdivided transversely by said blade into a pair of halves having at said drum staggered and interfitting handle flaps;

means for rotating said drum at a peripheral speed different from said feed speed, whereby said tube slips on said drum and said flaps are spaced longitudinally apart on said tube spacing equal to said bag width and a function both of said feed speed and of said peripheral speed;

deflecting guides between said drum and said downstream feed roller engaging only one of said halves and detouring same through a distance equal to an odd whole-number multiple of half of said bag width, whereby said flaps of said halves are in exact transverse juxtaposition downstream of said deflecting guides; and means adjacent said downstream roller for transversely seaming together each of said tubes at seams between said flaps.

4. The apparatus defined in claim 3, further comprising drive means connected to said feed means and means for rotating for synchronously driving said rollers and cutting drum.

5. The apparatus defined in claim 3 wherein said drum is formed with an endless circumferentially extending and undulating guide groove axially offset from and parallel to said cutting groove, said apparatus further comprising a cam follower engaged in said guide groove and structure axially rigidly connecting said cam follower and said blade for joint axial displacement.

6. The apparatus defined in claim 5 wherein said blade is generally planar, said apparatus further comprising means for rotating said blade about an axis generally radial of said drum axis for holding said blade parallel to the section of said cutting groove in which it is engaged.

7. The apparatus defined in claim 6 wherein said means for rotating includes a crank drive connected between said blade and said drum.

8. The apparatus defined in claim 5, further comprising a blade holder, at least one axially extending rod on which said blade holder is axially slidable, at least one axially extending rod on which said cam follower is axially slidable, and a rigid element axially interconnecting said holder and follower.

9. The apparatus defined in claim 3 wherein said deflecting guides include three deflecting rollers one of which is displaceable relative to the other two.

* * * * *